US008341765B2

(12) United States Patent
Brodbeck

(10) Patent No.: US 8,341,765 B2
(45) Date of Patent: Jan. 1, 2013

(54) GARMENT FOR TRAINING SWIMMERS

(76) Inventor: Ralph R Brodbeck, Cincinnati, OH (US)

( * ) Notice: Subject to any disclaimer, the term of this patent is extended or adjusted under 35 U.S.C. 154(b) by 59 days.

(21) Appl. No.: 12/609,340

(22) Filed: Oct. 30, 2009

(65) Prior Publication Data

US 2010/0107297 A1 May 6, 2010

Related U.S. Application Data

(60) Provisional application No. 61/109,744, filed on Oct. 30, 2008.

(51) Int. Cl.
*A41D 5/00* (2006.01)

(52) U.S. Cl. ..... 2/67; 482/55

(58) Field of Classification Search ..... 2/67, 238, 2/247, 69, 242, 170, DIG. 5; 434/254; 482/55
See application file for complete search history.

(56) References Cited

U.S. PATENT DOCUMENTS

| | | | | | |
|---|---|---|---|---|---|
| 169,396 | A | | 11/1875 | Ahlstrom | |
| 648,697 | A | | 5/1900 | Kurts | |
| 1,067,612 | A | | 7/1913 | Lamb | |
| 1,260,931 | A | | 3/1918 | Melhus | |
| 1,397,729 | A | * | 11/1921 | Morris | 2/253 |
| 1,411,909 | A | | 4/1922 | Condon | |
| 1,480,366 | A | | 1/1924 | Bergerson | |
| 1,508,650 | A | | 9/1924 | Dueker | |
| 1,695,125 | A | | 12/1928 | Rensing | |
| 2,771,618 | A | | 11/1956 | Crum | |
| 3,231,899 | A | * | 2/1966 | Seidel et al. | 2/93 |
| 3,584,870 | A | | 6/1971 | Garst | |
| 4,071,236 | A | * | 1/1978 | Oprean | 482/55 |
| 4,074,904 | A | * | 2/1978 | Arcidiacono | 482/55 |
| 4,084,586 | A | | 4/1978 | Hettick | |
| 4,302,007 | A | * | 11/1981 | Oprean et al. | 482/55 |
| 4,384,369 | A | * | 5/1983 | Prince | 2/79 |
| 4,411,422 | A | | 10/1983 | Solloway | |
| 4,721,300 | A | | 1/1988 | Guzman | |
| 4,832,010 | A | | 5/1989 | Lerman | |
| 5,002,270 | A | * | 3/1991 | Shine | 482/105 |
| 5,361,412 | A | * | 11/1994 | Perry | 2/69 |
| 5,465,425 | A | * | 11/1995 | Crispin | 2/102 |
| 5,487,710 | A | * | 1/1996 | Lavorgna et al. | 482/55 |
| 6,241,135 | B1 | * | 6/2001 | Thatcher | 224/148.5 |
| 6,425,137 | B1 | * | 7/2002 | Fakhrai | 2/170 |
| 2004/0221355 | A1 | | 11/2004 | Garcia | |
| 2005/0215135 | A1 | | 9/2005 | Hall | |
| 2010/0197468 | A1 | * | 8/2010 | Zhang | 482/55 |

* cited by examiner

*Primary Examiner* — Khoa Huynh
*Assistant Examiner* — Anna Kinsaul
(74) *Attorney, Agent, or Firm* — Wood, Herron & Evans, LLP

(57) ABSTRACT

A training garment is provided for use by a swimmer. The garment includes a layer of material that is configured to conform to a body portion of the swimmer, and a plurality of pockets that extend from the layer of material for increasing drag on the swimmer as the body portion is moved in a preselected direction of movement. At least one of the pockets has first and second conditions. In the first condition, drag is increased by that pocket on the swimmer as the body portion moves in the preselected direction of movement. In the second condition, drag is not increased by that pocket on the swimmer as the body portion moves in the preselected direction of movement.

19 Claims, 8 Drawing Sheets

GARMENT FOR TRAINING SWIMMERS

CROSS-REFERENCE TO RELATED APPLICATION

This application claims the filing benefit of U.S. Provisional Patent Application Ser. No. 61/109,744 filed Oct. 30, 2008, the disclosure of which is hereby expressly incorporated by reference herein in its entirety.

TECHNICAL FIELD

The present invention relates generally to garments and, more particularly, to a drag increasing garment to be worn while swimming.

BACKGROUND

In the sport of competitive swimming, it is known that the development and strengthening of swimming muscles is crucial to creating the competitive edge needed to win. Along with proper swimming technique, developing strong swimming muscles and improving their endurance directly relates to a swimmer's ability to perform at peak potential. One method that swimmers use to strengthen muscles is to follow a dry-land strength training and aerobic-conditioning program. While those methods may help improve overall power, such programs do not isolate swimming specific muscles, and often compromise proper swimming technique.

Others have tried to address the above issue by creating articles to wear or carry into the water to increase the resistance a swimmer faces. For example, belts with pockets increase a swimmer's drag through the water making swimming more difficult thereby developing swimming specific muscles without sacrificing proper swimming technique. Suits with pockets have also been used to strengthen swimming muscles in a natural swimming environment.

Although devices such as those mentioned above provide resistance to the movement of the swimmer through the water, they have many drawbacks.

Thus, there is a need for a device for training swimmers that overcomes the problems associated with other devices.

SUMMARY

In one embodiment, a training garment is provided for use by a swimmer. The garment includes a layer of material that is configured to conform to a body portion of the swimmer, and a plurality of pockets that extend from the layer of material for increasing drag on the swimmer as the body portion is moved in a preselected direction of movement. At least one of the pockets has first and second conditions. In the first condition, drag is increased by the at least one of the pockets as the body portion moves in the preselected direction of movement. In the second condition, drag is not increased by the at least one of the pockets as the body portion moves in the preselected direction of movement.

The garment may include a flap proximate the at least one of the pockets for selectively opening and closing access into the pocket, with opening and closing of the pocket respectively corresponding to the first and second conditions thereof. The flap may, for example, be configured for tucking into the at least one of the pockets in the first condition. The flap may, alternatively or additionally, include a fastener for securing the flap relative to the pocket in the second condition. The flap may be made of a material that is similar to that of the layer of material. The at least one of the pockets may include a second layer of material that is coupled along opposed sides thereof to the first layer, with the flap being made of a material that is similar to or different from that defining the second layer of material.

In a specific embodiment, at least one of the pockets has an entry defining a first cross-sectional area and an exit defining a second cross-sectional area that is smaller than the first cross-sectional area. At least one of the pockets is oriented on the layer of material so as to permit the flow of water from the entry to the exit as the body portion moves in the preselected direction of movement. Each of the plurality of pockets may extend along a respective pocket longitudinal centerline, with two of the plurality of pockets being oriented, in one embodiment, such that their respective pocket longitudinal centerlines are not parallel to one another when the garment is being worn by the swimmer.

In another specific embodiment, each of the pockets extends along a respective pocket longitudinal centerline and the layer of material extends along a main longitudinal centerline of the garment, with at least one of the plurality of pockets being oriented such that its pocket longitudinal centerline is not parallel to the main longitudinal centerline of the garment. The layer of material may define a front side and an aft side, with the plurality of pockets being arranged on the front side or the aft side in one of a generally X pattern or a generally cross pattern. The garment may additionally or alternatively include an adjustment apparatus for selectively varying a dimension of the layer of material so as to conform to different body portions.

The garment may be configured to conform about an elbow of the swimmer and body portions adjacent the elbow, with the garment having a web coupled to the layer of material and extending generally transverse thereto. The web is configured to increase drag on the swimmer as the elbow moves in a second direction different from the preselected direction of movement.

In another embodiment, the garment may be configured to conform about a foot of the swimmer and body portions adjacent the foot, with the garment having a web coupled to the layer of material and extending generally transverse thereto. The web is configured to increase drag on the swimmer as the foot moves in a second direction different from the preselected direction of movement. The garment may be configured to conform to the torso of the swimmer or may be in the form of a belt configured to conform to the waist of the swimmer.

In another embodiment, a training garment is provided for use by a swimmer. The garment includes a layer of material that is configured to conform to a body portion of the swimmer, and a plurality of pockets extending from the layer of material for increasing drag on the swimmer as the body portion moves in a preselected direction of movement. The garment of this embodiment includes a plurality of flaps, each proximate one of the pockets, and selectively positionable to block and provide access into one of the pockets for respectively preventing and increasing drag on the swimmer. Each of the plurality of flaps may include a fastener for releasably coupling each of the flaps to a respective one of the pockets or to an area adjacent the pocket. Alternatively or additionally, each of the plurality of pockets extends along a respective pocket longitudinal centerline, with two of the plurality of pockets being oriented such that their respective pocket longitudinal centerlines are not parallel to one another when the garment is being worn by the swimmer.

In yet another embodiment, a method is provided for performing swim training. The method includes wearing a garment on a body portion with the garment having a first pocket which, in a first condition, is configured to increase drag on the body portion. The first pocket is selectively reconfigured into a second condition wherein the first pocket does not increase drag on the body portion. The method may include selectively moving a second pocket between first and second conditions similar to the first and second conditions of the first pocket. The method may, alternatively or additionally, include actuating an adjustment apparatus of the garment to vary a dimension thereof so as to conform to the body portion on which the garment is worn. Selectively moving the first and second pockets may be carried out, in one embodiment, while the garment is being worn on the body portion.

BRIEF DESCRIPTION OF THE DRAWINGS

These and other objects, features and advantages of the present invention will become more apparent to those of ordinary skill in the art upon reviewing the detailed description below with reference to the following figures.

DETAILED DESCRIPTION

Figure 1:
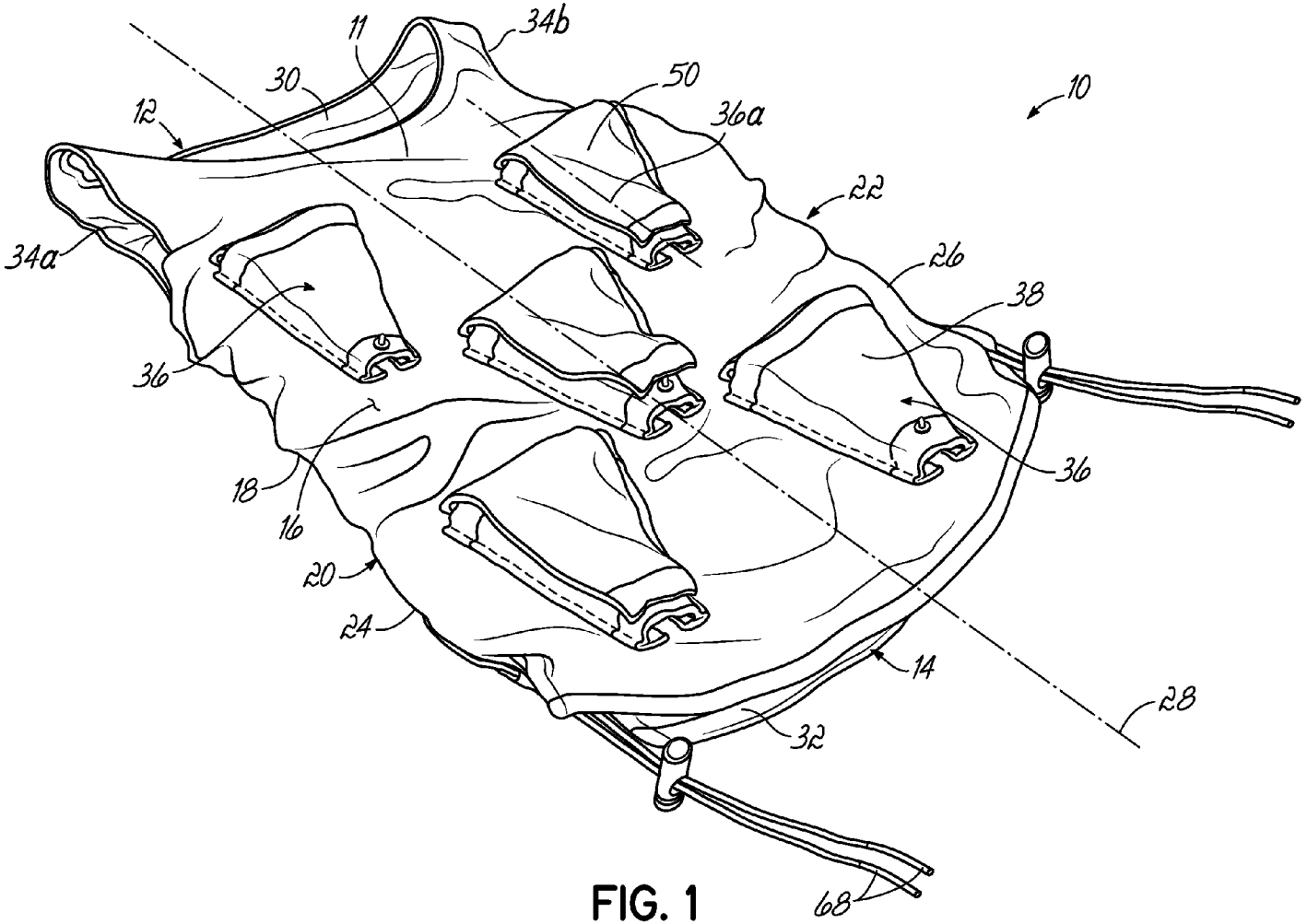
FIG. 1 is a perspective view illustrating a front face of a swim training garment in accordance with one embodiment of the present invention.

With reference to the figures and, more particularly FIGS. 1, 1A, 2, and 3, a training garment 10 to be worn on the upper body, i.e., torso, is illustrated. In this embodiment, the garment 10 includes a first layer of material 11 made from one or more commercially available materials used in competitive swimwear, such as spandex (e.g., Lycra®) or other low-absorbing materials. Low-absorbing materials do not significantly increase the swimmer's water weight, and thus lessen the negative effect of lowering the swimmer in the water, which may otherwise potentially hinder the swimmer's technique.

The garment 10 generally comprises a forward end 12, an aft end 14, a front face 16, an aft face 18, a right side 20, a left side 22, a right seam 24, and a left seam 26. A longitudinal centerline 28 extends between the forward end 12 and the aft end 14. The garment 10 of the illustrated embodiment includes a neck opening 30, a torso opening 32 disposed opposite neck opening 30, and right and left arm openings 34*a*, 34*b*. In one embodiment, both male and female swimmers wear the same basic garment over their regular swimsuits. In other embodiments the garment 10 could be tailored to a generally male or female shape. In yet another embodiment, the garment could be tailored to a particular individual. The garment may, alternatively or additionally, be designed to replace a swimsuit.

Referring to FIGS. 1, 1A, 2, and 3, the exemplary garment 10 includes a plurality of drag cavities or pockets 36 located on the front face 16 and aft face 18. Specifically, each pocket 36 is defined by a second layer of material 38 that is sewn onto the faces 16, 18 of the garment 10 along cavity seams 42*a*, 42*b*, to define a generally funnel-shaped channel 40. The second layer of material 38 may be similar to or different from the material defining the first layer of material 11. For example and without limitation, the second layer of material 38 may be made from a low-porosity nylon or from other materials. A material fold seam 44 helps retain each pocket 36 in a generally open condition, such that water may readily flow through channel 40. The second layer of material 38 may be coupled to the first layer of material 11 in a variety of ways, including, for example, rivets, buttons, and adhesives, in addition or as an alternative to sewing.

The pockets 36 resist the flow of water over the swimmer during training by forcing water to flow through channels 40. In particular, in this embodiment, the pockets 36 are tapered, having a water entry 46 at one end and a water exit 48 defining a cross-sectional area smaller than that of the water entry 46. Some of the pockets 36 are oriented such that their pocket longitudinal centerlines 36*a* are generally parallel to a longitudinal centerline 28 of the garment 10, while others, as illustrated in FIG. 1A, are oriented such that their longitudinal centerlines 36*a* are not parallel to the longitudinal centerline 28 of garment 10. Further, some of the pockets 36 may be oriented such that their respective pocket longitudinal centerlines 36*a* are either parallel or not parallel to one another. The pockets 36 may be sealed at one end, thus eliminating the water exit 48, and thereby defining a close-ended pocket or drag cavity. In yet another embodiment, the drag cavities 36 may have a reverse tapered cavity shape or may not have a taper at all. The pockets 36 may be oriented in various positions on the garment faces 16, 18 to encourage the strengthening and conditioning of specific swimming muscles. For example, and without limitation, some of the pockets 36 may be oriented non-parallel to the longitudinal centerline 28 (FIG. 1A) to train swimmers to resist lateral rolling motions, for example.

Figure 1A:
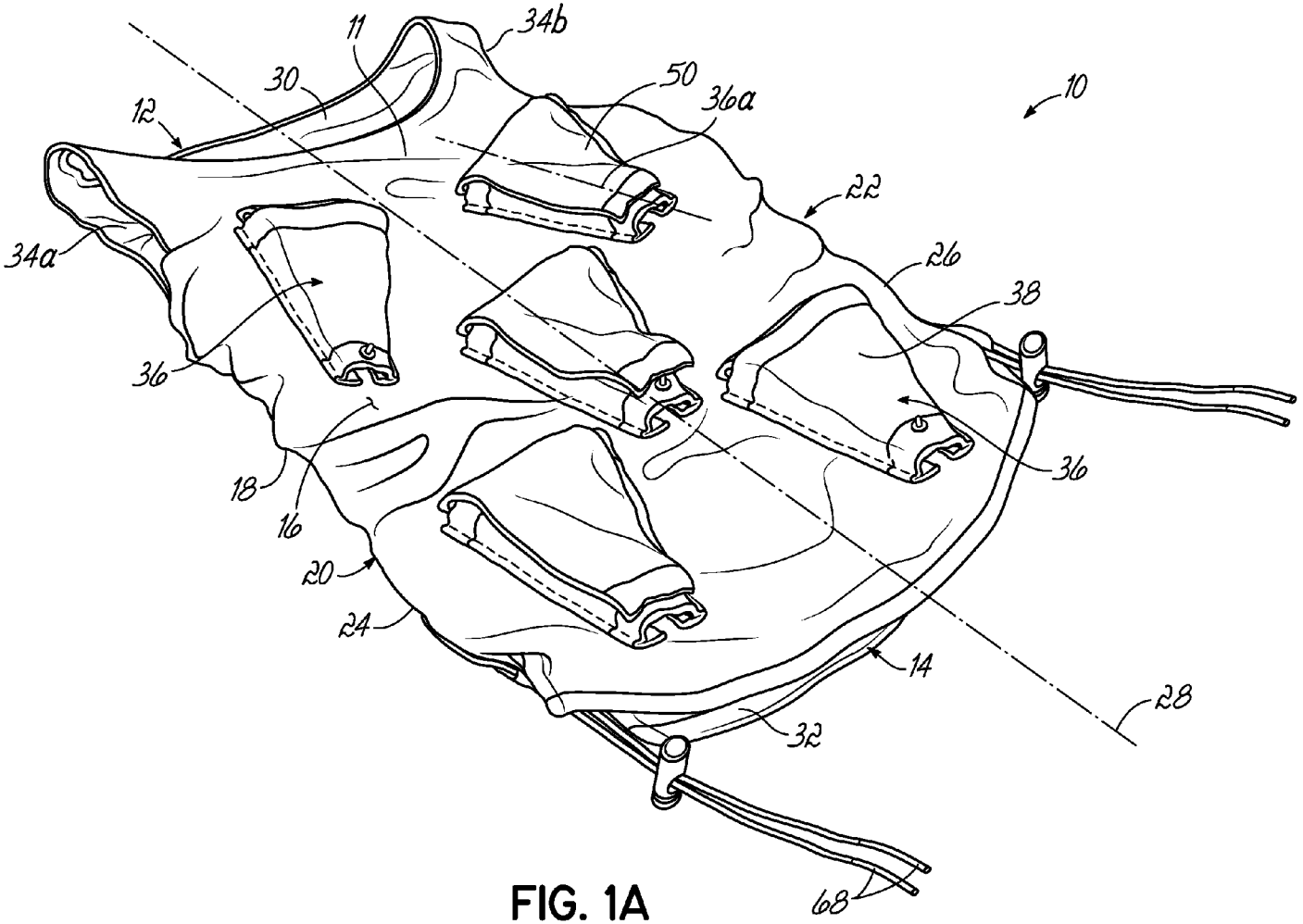
FIG. 1A is a perspective view, similar to FIG. 1, illustrating another embodiment of a swim training garment.
Figure 2:
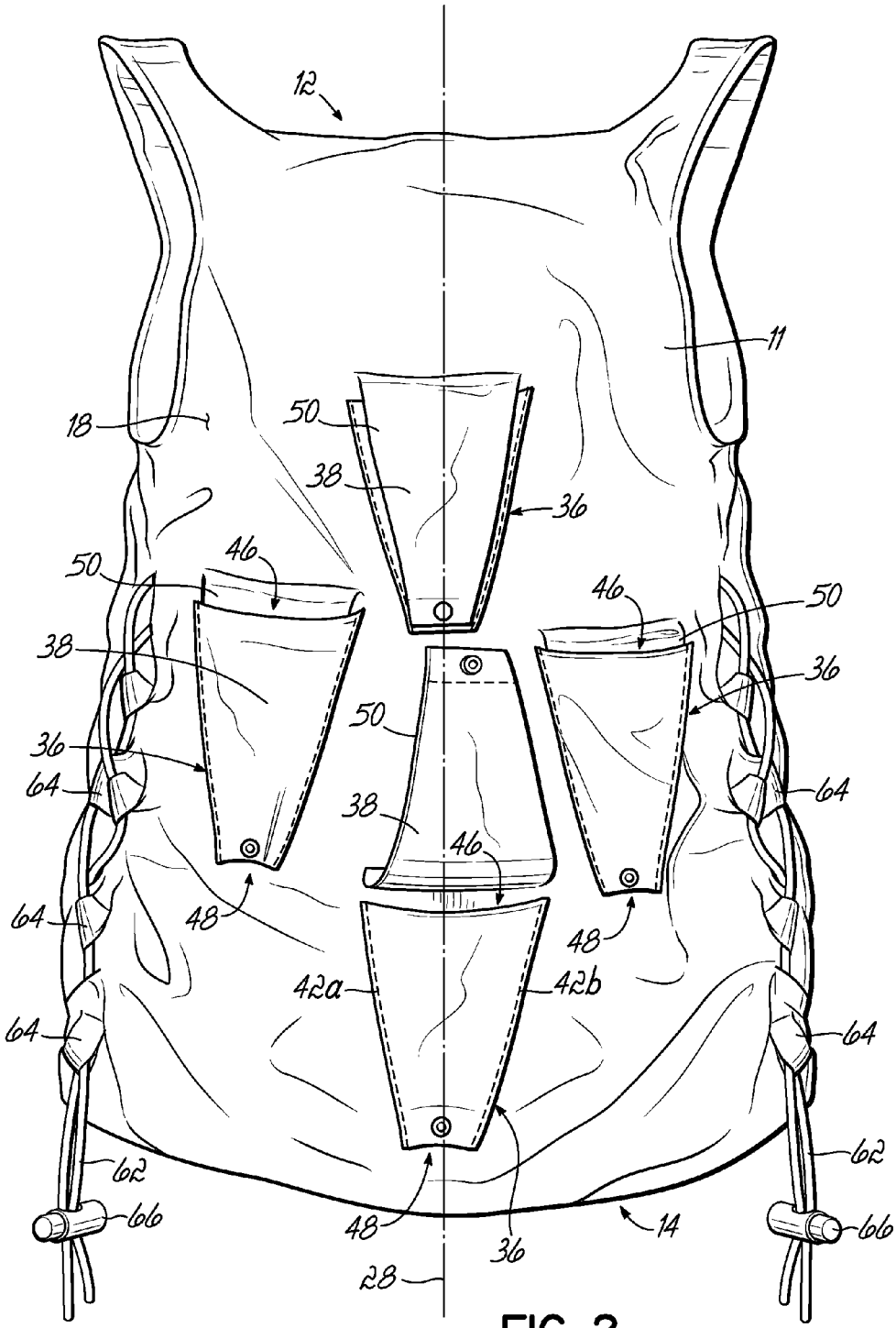
FIG. 2 is a perspective view illustrating an aft face and right side of the embodiment of FIG. 1.

In the embodiment of FIGS. 1 and 2, the garment 10 has five pockets 36 on the front face 16 and four on the aft face 18, although this is merely illustrative rather than limiting. In this regard, it is contemplated that garment 10 may have pockets 36 in any number and arranged in any predetermined pattern or, alternatively, randomly arranged. As shown in FIG. 1, the exemplary predetermined pattern on the front face 16 has one pocket 36 along the longitudinal centerline 28, two pockets 36 adjacent the right side 20, generally parallel to the longitudinal centerline 28, and two pockets 36 adjacent the left side 22, generally parallel to the longitudinal centerline 28, with the pockets 36 thereby arranged in an "X" pattern. The symmetry in this embodiment provides for similar water resistance across the front of the swimmer, preventing any tendency for the swimmer to be pulled in a particular direction, which would otherwise disturb proper swimming technique. Placement of the pockets 36 may be varied so as to distribute the water resistance over the surface area of the garment 10, as desired.

As shown in FIG. 2, the pockets 36 are arranged on aft face 18 such that two pockets 36 are located approximately along the longitudinal centerline 28, a first pocket 36 adjacent forward end 12 and a second pocket 36 adjacent the aft end 14. A third pocket 36 is located adjacent the right side 20 of the garment 10, generally parallel to and midway between the first and second pockets 36. A fourth pocket 36 is located adjacent the left side 22 of the garment 10, generally parallel to the longitudinal centerline 28 and midway between the pockets 36 that are located along the longitudinal centerline 28. This predetermined pattern, thus, has the shape of a cross or a plus sign. The symmetry of the pattern on the aft face 18 provides similar benefits to those described above with reference to the pattern on the front face 16. The predetermined exemplary patterns of FIGS. 1 and 2 are not intended to be limiting but are rather illustrative, insofar as the pockets 36 may be arranged in various patterns, with various orientations or locations, and in any number, with the goal of training a swimmer.

With continued reference to FIGS. 1 and 2, a flap 50 is selectively positionable relative to each pocket 36 so as to open and close the water entry 46 of each pocket 36. In this embodiment, the flap 50 is fabricated from the same commercially available spandex material from which the first layer of material 11 and second layer of material 38 may be made, although it is contemplated that flap 50 may be fabricated from a variety of materials.

Figure 3:
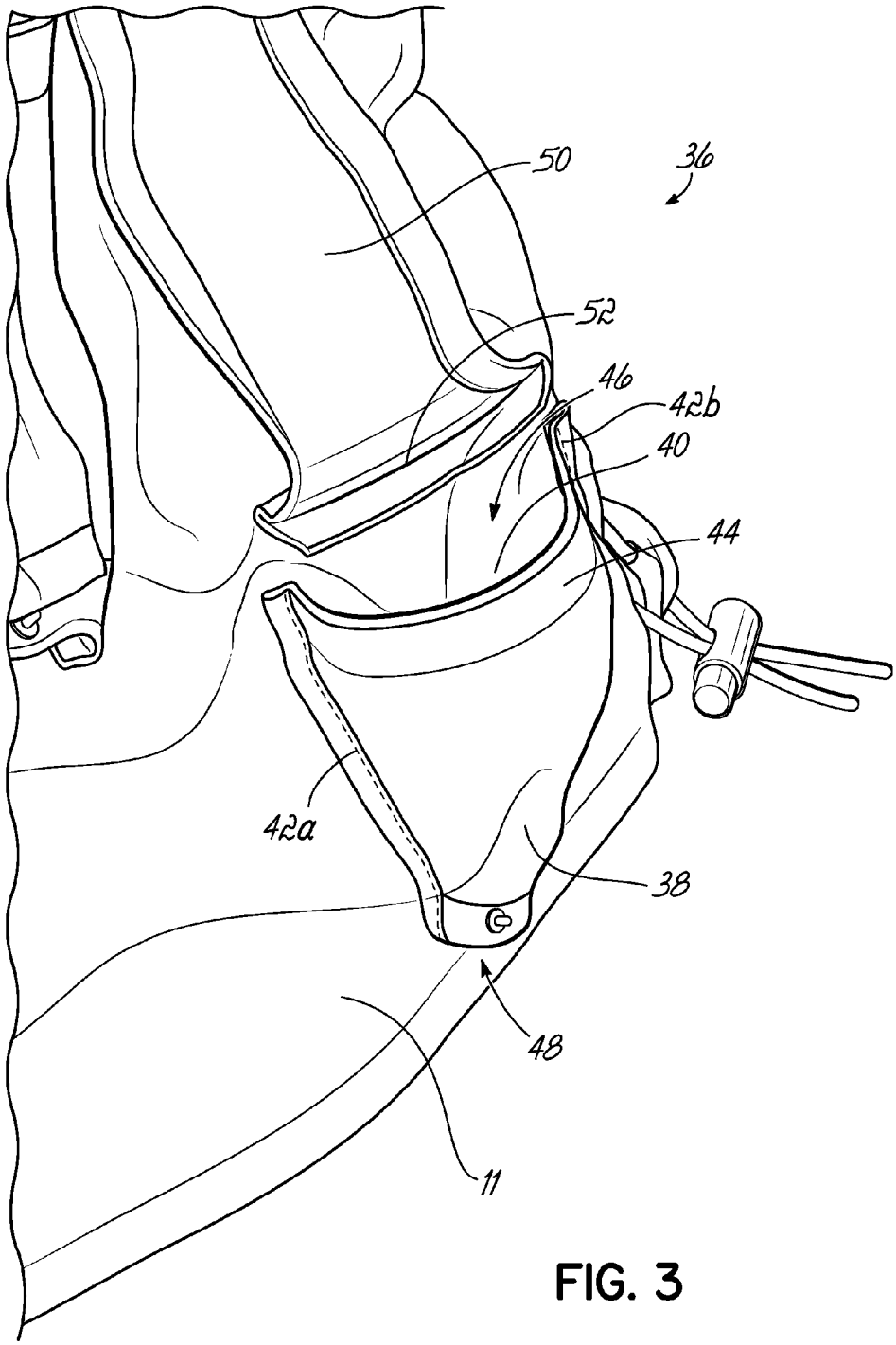
FIG. 3 is a perspective view illustrating a drag cavity or pocket of the garment depicted in FIGS. 1 and 2.

In this embodiment, the flaps 50 and the pockets 36 are fixedly coupled to the first layer of material 11 of garment 10 and therefore cannot be accidentally detached while training, or lost in storage. Specifically, and as illustrated in FIG. 3, each flap 50 is sewn to the aft face 18, along a flap seam 52, adjacent water entry 46. The flap 50 may, additionally or alternatively, be coupled to the first and/or second layers of material 11, 38 via buttons, rivets or adhesives, for example.

Figure 4:
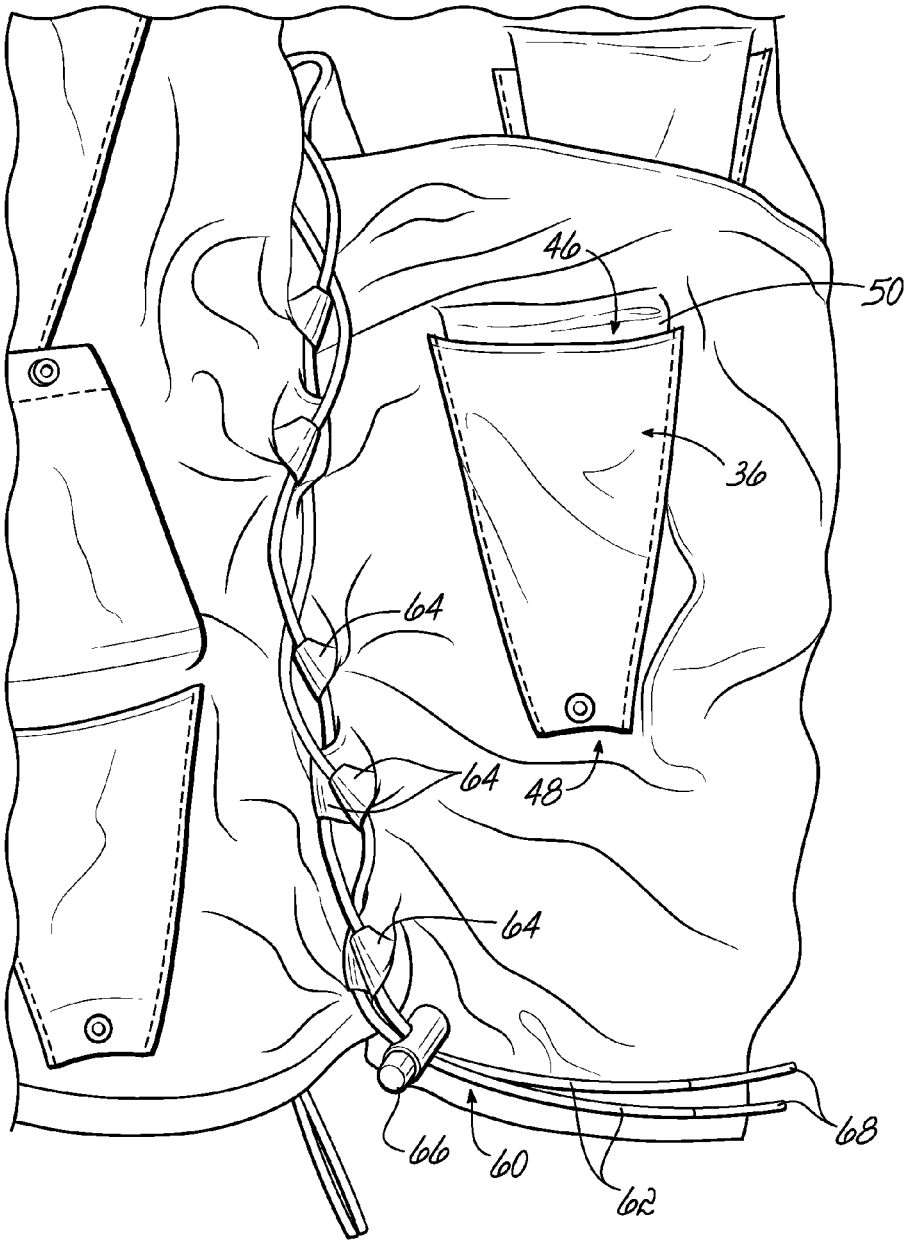
FIG. 4 is an elevation view illustrating the left side of the swim training garment of FIGS. 1-3.

When it is desired to have a pocket 36 increase drag on the swimmer as the swimmer moves in a preselected direction of movement, the swimmer or an assistant tucks the flap 50 through water entry 46 and into the channel 40, as illustrated in FIG. 4. The flap 50 tucked inside the pocket 36 helps to keep the pocket 36 in its open, drag-increasing condition. In this condition, pocket 36 catches flowing water, thereby generating resistance to movement of the swimmer. Conversely, when it is desired for a pocket 36 not to increase drag on the swimmer as the swimmer moves in the preselected direction of movement, the flap 50 is secured over the pocket 36 to keep the water entry 46 closed, thus placing the pocket 36 in a second, non-drag-increasing condition.

As used herein, the phrase "increasing drag," "not increasing drag," and terminology derived from these phrases, are intended to denote a relative measure of the drag exerted on the swimmer between the two conditions of the pockets 36, and is not limited to a comparison relative to the absolute absence of a pocket 36, for example. More specifically, a pocket 36 in its "non-drag-increasing" condition refers to a pocket 36 that induces an amount of drag on the swimmer that is less than in its "drag-increasing" condition. In this regard, the present disclosure also contemplates a "non-drag-increasing" condition in which the pocket 36 induces an amount of drag on the swimmer that may be similar to the amount of induced drag if the pocket 36 were not present at all.

The flap 50 provides the swimmer with an expeditious way to customize the garment 10 for a particular swimmer's needs. The flap 50 allows a pocket 36 to be quickly closed or opened, eliminating the need for a swimmer to use another garment to make adjustments in training. The flaps 50 allow the garment 10 to be adjusted without adding or subtracting additional components to or from the garment 10. The ability to quickly close one or more pockets 36 is advantageous, for example, when a swimmer prefers to condition one side of the body more than another. In such a case, different ones of the pockets 36 may be selectively opened or closed to provide non-uniform resistance across the swimmer's body. The specific number and arrangement of pockets 36 that are kept open or closed may be tailored to the skill level and training goals of the swimmer.

Figure 5:
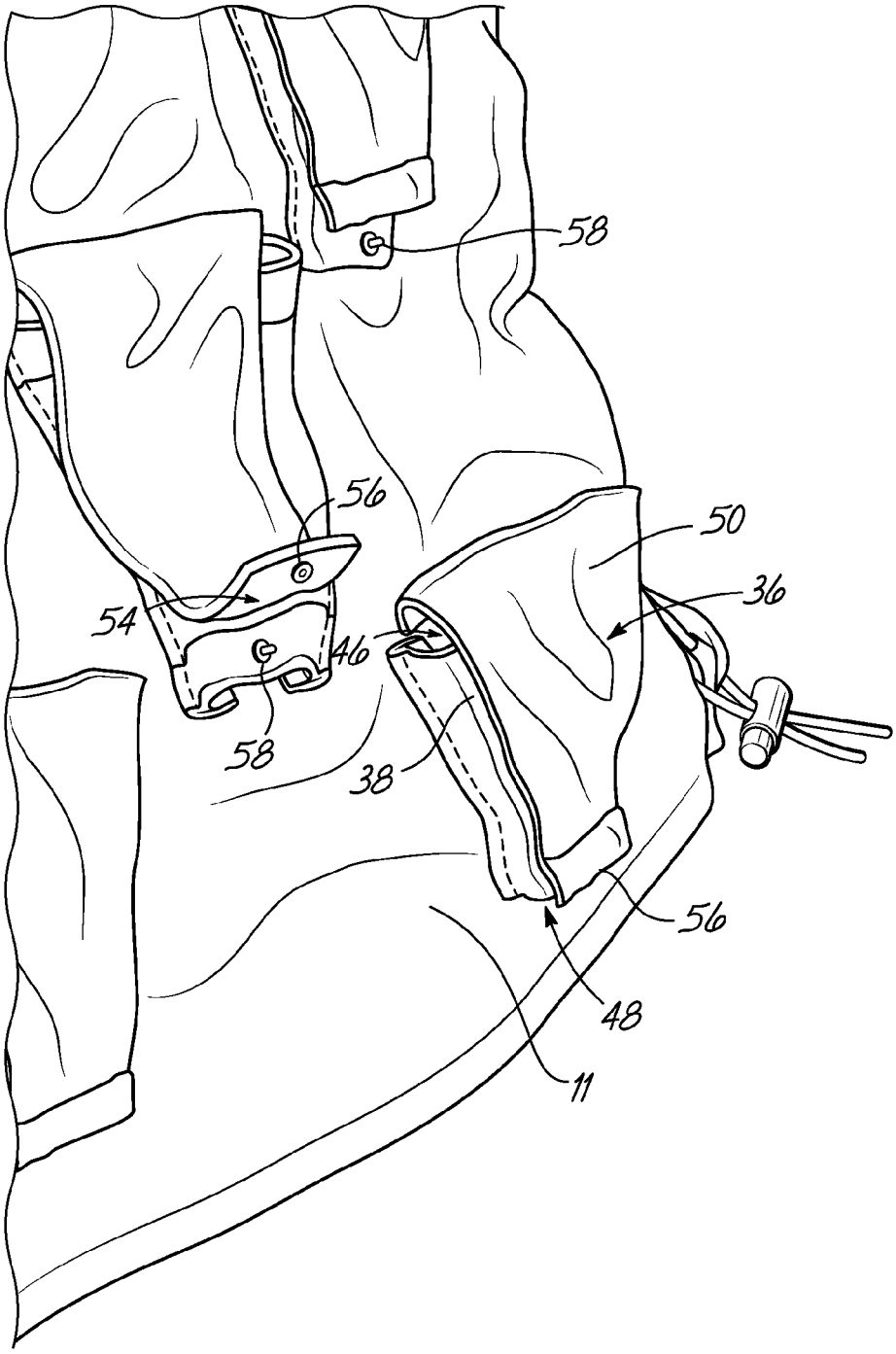
FIG. 5 is a perspective view illustrating a lower portion of the garment of FIGS. 1-4.

In the embodiment illustrated in FIG. 5, the flaps 50 extend over the pockets 36 and are secured to the second layer of material 38 adjacent the water exit 48. Alternatively, the flaps 50 may be secured to the first layer of material 11 and still block water entry 46. A fastener 54 secures the flap 50 in place. In this embodiment, the fastener 54 is in the form of a plastic snap button head 56 sewn into the material making up flap 50, and a snap button base 58 that is sewn onto the second layer of material 38. Fasteners are installed in ways that avoid any abrasion to the swimmer's skin. Although in the embodiments described herein every pocket 36 has a flap 50 associated therewith and which is installed in the same way, it is contemplated that, alternatively, flap 50 may not be provided to cover every pocket 36. Further, the flap 50 may be coupled to any portion of garment 10 at different locations, or may not be coupled to garment 10 at all.

Referring against to FIG. 4, an exemplary embodiment is illustrated of an adjustment apparatus 60 for adjusting the size and fit of the garment 10. The adjustment apparatus 60 generally includes a cord 62 woven through a plurality of loops 64 along the seams 24, 26. In the illustrated embodiment, there are respective adjustment apparatuses 60 on both, the right side 20 and left side 22 that define the right seam 24 and the left seam 26. However, the seams 24, 26 and adjustment apparatus 60 may take other forms. For example, and without limitation, the seams may be sewn or stitched, with adjustment apparatus 60 resting on the sewn seams.

The cord 62 is woven through the loops 64 in such a manner that the first layer of material 11 may be selectively bunched and gathered so as to conform to a body portion e.g., to reduce its size, such that the first layer of material 11 collects evenly and lies flat against the swimmer's body portion (e.g., torso). This allows the garment 10 to be a comfortable, adjustable form-fitting training garment. Additionally, the loops 64 protect the swimmer's body from the cord 62. In the exemplary embodiment of FIG. 4, the cord 62 is fabricated from nylon coated natural rubber, but may be instead fabricated from other materials. The cord 62 is preferably resistant to chlorine and UV radiation to prevent deterioration.

The adjustment apparatus 60 is retained at a desired size setting by a lock 66. In this embodiment, both ends of cord 62 pass through an aperture in lock 66 that is spring loaded to secure the aft ends of cord 62. In use, the user pulls down on the aft ends of cord 62, while pressing the lock 66, until the garment 10 is adjusted to the desired size, at which time the lock 66 is released. In this embodiment, the ends of the cords 62 have an easy grip 68, further simplifying the adjusting process. The easy grip 68 is formed by pulling nylon cord coating beyond the natural rubber core and melting the nylon to seal the ends. Each side of the garment 10 may be adjusted independently. In this way, the garment 10 is fully adjustable within a span of sizes, and able to conform to various body shapes or sizes. The above embodiment is without limitation, insofar as other variations of the adjustment apparatus 60 will readily appear to one of ordinary skill in the art.

Figure 6:
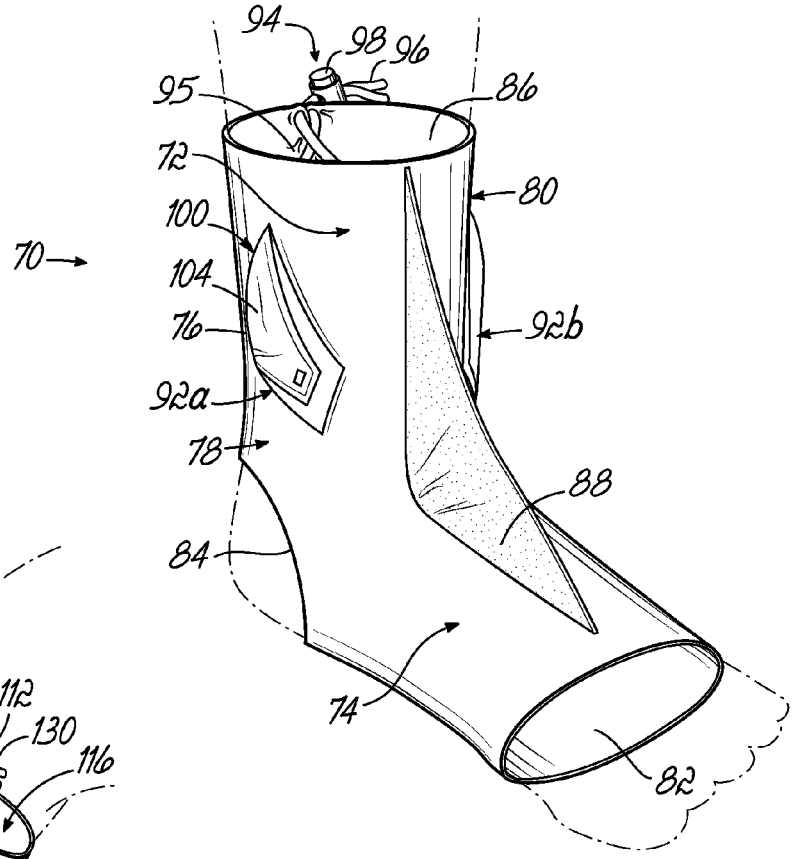
FIG. 6 is a schematic perspective view of another embodiment of a swim training garment.

FIG. 6 illustrates another embodiment of a swim training garment, in the form of a training sock 70 worn over the swimmer's lower leg, ankle, and foot. In one embodiment, the training sock 70 is fabricated from a flexible spandex material for reasons similar to those discussed above. The training sock 70 has an upper portion 72, a lower portion 74, a rear face 76, a right side 78, a left side 80, a toe opening 82, a heel opening 84, and an opening 86 for the lower leg. Drag cavities or pockets 92*a*, 92*b*, similar to the pockets 36 of garment 10, are coupled above the ankle on the right side 78 and the left side 80. An adjustment apparatus 94 extends along the rear face 76, up the calf of the leg. In this embodiment, the adjustment apparatus 94 defines a rear seam 95 along the rear face 76, although other variations are within the scope of the present disclosure. The adjustment apparatus 94 may be similar to adjustment apparatus 60, discussed above, and have similar structure, functionality, and advantages to those of apparatus 60. A web 88 extends substantially from the top of the foot and up the shin and protrudes in a plane that is generally transverse to the front face of the sock 70. The web 88 defines a drag-increasing element which may be made up of a solid material or a porous or mesh-like material.

In use, the training sock 70 is pulled into position around the leg by first inserting the lower foot into the leg opening 86 and then pushing the foot through the inside of the training sock 70 and out through the toe opening 82. The heel is situated in the heel opening 84, and the adjustment apparatus 94 extends along the calf of the leg. The web 88 resists the flow of water around the foot, especially resisting the downward, kicking stroke of the leg in the swimming motion (i.e., in a direction different from the preselected direction of movement of the swimmer). The web 88 may help the swimmer train for specific swimming strokes, like the butterfly stroke, for example. The pockets 92*a*, 92*b* and/or the web 88 may be oriented differently or be placed in positions different from those shown.

The adjustment apparatus 94 along the rear face 76 provides easy access to cords 96 and a lock 98 of apparatus 94, allowing adjustment on land as well as in water. The excess material is gathered to lay flat along the back of the leg. In one embodiment, the pockets 92*a*, 92*b* above the ankle on the right side 78 and left side 80 are oriented so a water entry 100 of each pocket 92*a*, 92*b* is angled towards the back of the leg, thereby adding resistance in the back kick. The pockets 92*a*, 92*b* may be oriented in various positions and be present in any number, and further have or not have a flap 104 (similar in structure and functionality to flap 50 of garment 10) associated therewith. The combination of the web 88 and the pockets 92*a*, 92*b* defines an efficient drag-increasing garment. The web 88 is optional, and may or may not be on the same garment as the pockets 92*a*, 92*b*. In one aspect, the heel opening 84 stabilizes the training sock 70, further increasing comfort and performance.

Figure 7:
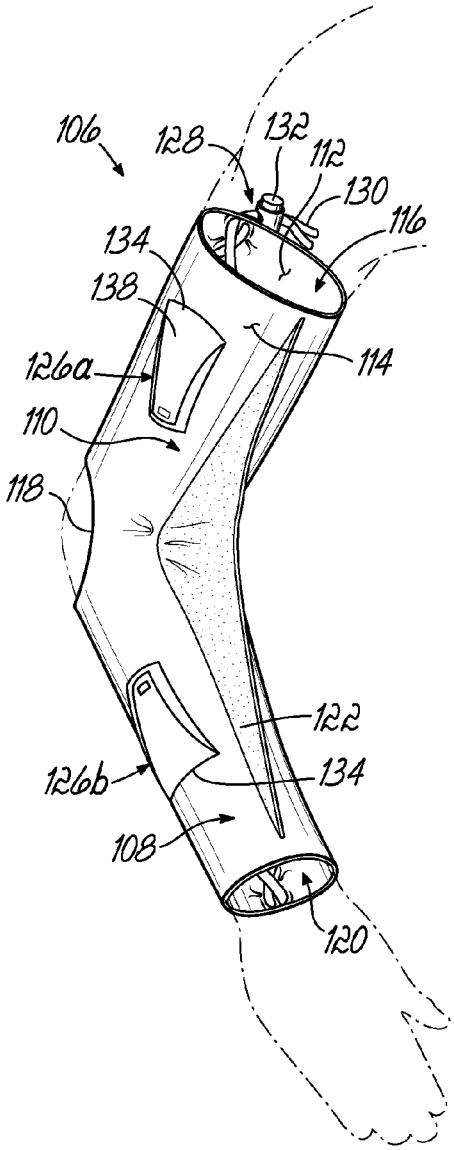
FIG. 7 is a schematic perspective view of yet another embodiment of a swim training garment.

FIG. 7 shows an embodiment of a garment in the form of an elbow sleeve 106, to be worn on the middle of the arm, over the elbow. The elbow sleeve 106 may be fabricated from a flexible spandex material, for reasons similar to those discussed above relative to garments 10 and 70. The elbow sleeve 106 has an upper portion 108, a lower portion 110, an inside face 112, and an outside face 114. An opening 116 receives the upper arm, an opening 118 receives the elbow, and an opening 120 receives the lower arm. Drag cavities or pockets 126*a* (only one shown), similar to the pockets 36 of garment 10, are coupled to the outside face 114. An adjustment apparatus 128 extends along the inside face 112. The adjustment apparatus 128 may be of similar structure and functionality, to those of the embodiments above, or it may take other forms. A web 122 spans along a substantial portion of the length of sleeve 106 and extends in a plane that is generally transverse to the outer face 114. In this embodiment, web 122 spans from the wrist area of the upper portion 108 to the upper-arm to thereby define a drag-increasing element, which may be made up of a solid material or a porous or mesh-like material.

In use, the elbow sleeve 106 is pulled into position around the arm by first inserting the hand into the opening 116 and then pushing the hand through the inside of the elbow sleeve 106 and out through the opening 120 until the elbow is situated in the elbow opening 118. The adjustment apparatus 128 extends along the inside of the arm. The web 122 resists the flow of water around the arm, especially resisting the upward motion of the arm (i.e., in a direction different from the preselected direction of movement of the swimmer). For example, and without limitation, this resistance may help the swimmer train for specific swimming strokes like the butterfly stroke, for example. The web 122 is optional, and may or may not be on the same garment as the pockets 126*a*.

The location of the adjustment apparatus 128 is generally along the inside face 112. Its location provides easy access to cords 130 and to a lock 132 of the apparatus 128. The excess material is gathered to lie flat along the back of the arm. In this embodiment, the pockets 126*a* are oriented such that the illustrated pocket 126*a* has a water entry 134 angled up the arm and such that a second pocket 126*a* (not shown) has a water entry that is angled down the arm, thereby adding resistance to the swimmer's arm in the forward and back pushing motion of swimming. Such an orientation may be particularly beneficial for the butterfly stroke, for example. The pockets 126*a* and respective flaps 138 may provide the same advantages, respectively, as the pockets 36 and flaps 50 described above. The pockets 126*a* may be oriented in various positions and be present in any number, with or without a flap 138. The elbow opening 118 stabilizes the sleeve in the correct position on the arm. Although the webs 88 and 122 of FIGS. 6 and 7 respectively define respective drag elements acting as such when flexed, it is contemplated that a drag element within the scope of the present disclosure may be in a different form. For example, a different drag element may be in the form of or include a recessed area, or may be in the form of an element that protrudes into the water and extends from the normal contours of the swimmer, but having a shape or structural relationship relative to the remaining portions of the garment that is different from that of the illustrated embodiments.

Figure 8:
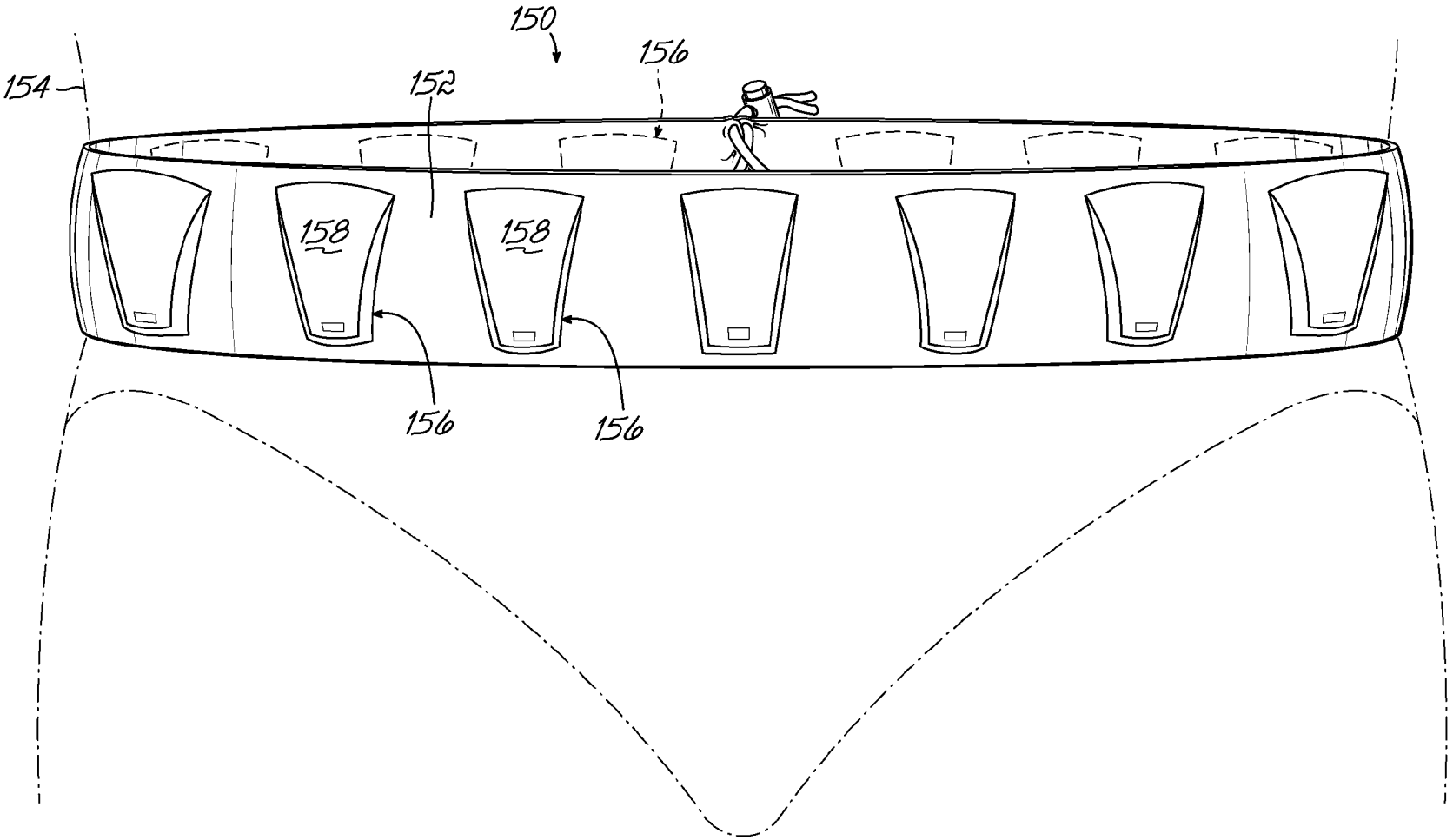
FIG. 8 is a schematic perspective view of another embodiment of a swim training garment.

With reference to FIG. 8, another embodiment is illustrated. In this figure, a garment 150 is in the form of a belt, and is made of a first layer of material 152 configured to conform to a swimmer's waist 154. Garment 150 includes a plurality of drag cavities or pockets 156 extending along a circumference of the garment 150, and a plurality of flaps 158, each associated with one of the pockets 156. The pockets 156 and flaps 158 are similar in structure and functionality to the pockets and flaps of the embodiments of FIGS. 1-7, the details of which may be referred to for an understanding of the pockets 156 and flaps 158. The materials defining the pockets 156 and flaps 158 may be similar or different from those described with reference to the embodiments of FIGS. 1-7.

It is contemplated that use of the garments of any of FIGS. 1-8 may include selectively having a first one of the pockets 36, 92*a*, 92*b*, 126*a*, 156 in a drag-increasing condition (e.g., open for water flow through the pocket) while having a second one of the pockets in a drag-increasing or in a non-drag-increasing condition (e.g., closed to not permit water to flow therethrough). Such arrangement may, for example, be used to exercise one specific group of the swimmer's muscles. It is further contemplated that the swimmer or an assistant may selectively reconfigure the first pocket into the non-drag-increasing condition and respectively reconfigure the second pocket into the non-drag-increasing or into the drag-increasing condition in order to exercise a different group of the swimmer's muscles. Notably, reconfiguration of any of the pockets between drag-increasing and non-drag-increasing conditions may be effected while the garment is being worn by the swimmer, and even while the swimmer is in the water.

While the present invention has been illustrated by a description of various embodiments and while these embodiments have been described in some detail, it is not the intention of the Applicant to restrict or in any way limit the scope of the appended claims to such detail. Additional embodiments and modifications will readily appear to those skilled in the art. For example, and without limitation, garments that cover the entire upper body, the thighs, the entire length of leg, or any combination thereof, are all within the scope of the present invention. The various features of the invention may be used alone or in any combination depending on the needs and preferences of the user. This has been a description of the present invention, along with the preferred methods of practicing the present invention, as currently known.

What is claimed is:

1. A training garment for use by a swimmer, comprising:

a layer of material configured to conform to a body portion of the swimmer; and a plurality of pockets extending from the layer of material, each pocket having first and second conditions, each of the pockets increasing drag on the swimmer as the body portion moves through water during swimming in a preselected direction of movement when the pocket is in the first condition, and each of the pockets not increasing drag on the swimmer as the body portion moves through water during swimming in the preselected direction of movement when the pocket is in the second condition, wherein when the pockets are in the first condition, the increased drag caused by water flowing through the pockets does not adversely affect proper swimming technique by dragging or pulling the swimmer in a transverse direction such as deeper into the water, and wherein each of the pockets is capable of being quickly opened and closed in combination with any subset of the plurality of pockets to provide customizable, targeted resistance across the body portion or only a part of the body portion.

2. The training garment of claim 1, further comprising:

a flap proximate the at least one of the pockets for selectively opening and closing access into the at least one of the pockets, the open and closed access of the at least one of the pockets respectively corresponding to the first and second conditions of the at least one of the pockets.

3. The training garment of claim 1, wherein the flap is configured for tucking into the at least one of the pockets in the first condition.

4. The training garment of claim 1, wherein the flap includes a fastener for releasably coupling the flap relative to the at least one of the pockets in the second condition.

5. The training garment of claim 2, wherein the at least one of the pockets includes two open ends defining an entry having a first cross-sectional area and an exit having a second cross-sectional area smaller than the first cross-sectional area, the at least one of the pockets being tapered to form a funnel-shaped channel between the entry and the exit, and the at least one of the pockets being oriented on the layer of material so as to permit the flow of water from the entry to the exit as the body portion moves in the preselected direction of movement.

6. The training garment of claim 1, wherein two of the plurality of pockets extend along respective pocket longitudinal centerlines which are not parallel to one another when the garment is being worn by the swimmer.

7. The training garment of claim 1, wherein:

one of the plurality of pockets extends along a pocket longitudinal centerline, and the layer of material extends along a main longitudinal centerline of the garment, the one of the plurality of pockets being oriented such that its pocket longitudinal centerline is not parallel to the main longitudinal centerline of the garment.

8. The training garment of claim 1, wherein the layer of material includes a front side and an aft side, the plurality of pockets being arranged on the front side or the aft side in a predetermined pattern.

9. The training garment of claim 1, further comprising:

an adjustment apparatus for selectively varying a dimension of the layer of material so as to selectively conform the training garment to different body portions, the adjustment apparatus including a plurality of loops coupled to the layer of material, a resilient cord woven through the plurality of loops, and a spring-loaded, lock for selectively securing the resilient cord with differing lengths through the plurality of loops, thereby adjusting the dimension of the layer of material to closely conform to the body portion, the lock may be pressed to immediately release the securing of the resilient cord in a particular position.

10. The training garment of claim 1, wherein the layer of material is configured to conform about an elbow of the swimmer and body portions adjacent the elbow or about a foot of the swimmer and body portions adjacent the foot, the garment further comprising:

a web coupled to the layer of material and extending in a plane generally transverse to the layer of material, the web being configured to increase drag on the swimmer as the elbow or the foot moves in a second direction different from the preselected direction of movement.

11. The training garment of claim 10, wherein the adjustment apparatus is configured to adjust an opening of the garment to conform the garment to the foot or elbow of the swimmer.

12. The training garment of claim 1, wherein the layer of material is configured to conform to a torso of the swimmer or a waist of the swimmer.

13. A training garment for use by a swimmer, comprising:

a layer of material configured to closely conform to a body portion of the swimmer;

an adjustment apparatus for selectively varying a dimension of the layer of material so as to conform the training garment to different body portions, the adjustment apparatus including a plurality of loops coupled to the layer of material, a resilient cord woven through the plurality of loops, and a spring-loaded, lock for selectively securing the resilient cord with differing lengths through the plurality of loops, thereby adjusting the dimension of the layer of material to closely conform to the body portion, the lock may be pressed to immediately release the securing of the resilient cord in a particular position;

a plurality of pockets extending from the layer of material for increasing drag on the swimmer as the body portion is moved through water during swimming in a preselected direction of movement, each pocket including two open ends defining an entry having a first cross-sectional area and an exit having a second cross-sectional area smaller than the first cross-sectional area, the pockets being tapered to form a funnel-shaped channel between the entry and the exit, and the pockets being oriented on the layer of material so as to permit the flow of water from the entry to the exit as the body portion moves through water during swimming in the preselected direction of movement; and a flap corresponding to and proximate each one of the pockets and selectively moveable between an opened position and a closed position, wherein drag on the swimmer is increased by flow of water through the funnel-shaped channel when the flap is in the opened position, and wherein drag is not increased on the swimmer when the flap is in the closed position, wherein when the flaps of the pockets are in the opened position, the increased drag caused by water flowing through the pockets does not adversely affect proper swimming technique by dragging or pulling the swimmer in a transverse direction such as deeper into the water.

14. The training garment of claim 13, wherein each of the plurality of flaps includes a fastener for releasably coupling each of the flaps relative to a respective one of the pockets.

15. The training garment of claim 13, wherein each of the plurality of pockets extends along a respective pocket longitudinal centerline, two of the plurality of pockets being oriented such that their respective pocket longitudinal centerlines are not parallel to one another when the garment is being worn by the swimmer.

16. The training garment of claim 13, wherein the layer of material is configured to conform to a torso of the swimmer or a waist of the swimmer.

17. A method of performing swimming training, comprising:

wearing a garment on a body portion of a swimmer, the garment having a plurality of pockets, wherein a first pocket of the plurality of pockets is configured to be in a first condition increasing drag on the body portion as the swimmer moves in a preselected direction of movement;

swimming through water in the preselected direction of movement with the first pocket of the plurality of pockets in the first condition to provide customizable, targeted resistance across the body portion or only a part of the body portion, wherein when the first pocket is in the first condition, the increased drag caused by water flowing through the first pocket does not adversely affect proper swimming technique by dragging or pulling the swimmer in a transverse direction such as deeper into the water; and selectively reconfiguring the first pocket from the first condition to a second condition wherein the first pocket does not increase drag on the body portion.

18. The method of claim 17, further comprising:

selectively reconfiguring at least a second pocket of the plurality of pockets between first and second conditions similar to the first and second conditions of the first pocket.

19. The method of claim 17, further comprising:

actuating an adjustment apparatus of the garment to vary a dimension thereof so as to selectively conform the garment to the body portion, the adjustment apparatus including a plurality of loops coupled to the layer of material, a resilient cord woven through the plurality of loops, and a spring-loaded, lock for selectively securing the resilient cord with differing lengths through the plurality of loops, the lock may be pressed to immediately release the securing of the resilient cord in a particular position, wherein actuating the adjustment apparatus includes securing the resilient cord with a varying length, thereby adjusting the dimension of the layer of material to closely conform to the body portion.

* * * * *